United States Patent [19]

Nakamura et al.

[11] Patent Number: 4,838,811

[45] Date of Patent: Jun. 13, 1989

[54] MODULAR CONNECTOR WITH EMI COUNTERMEASURE

[75] Inventors: Masaru Nakamura; Shuichi Matsuzaki, both of Tokyo, Japan

[73] Assignee: Hirose Electric Co., Ltd., Tokyo, Japan

[21] Appl. No.: 92,768

[22] Filed: Aug. 13, 1987

[30] Foreign Application Priority Data

Aug. 22, 1986 [JP] Japan ..... 61-127903
Aug. 22, 1986 [JP] Japan ..... 61-127904

[51] Int. Cl.[4] ..... H01R 13/648
[52] U.S. Cl. ..... 439/607; 439/610
[58] Field of Search ..... 439/607–610

[56] References Cited

U.S. PATENT DOCUMENTS 4,337,989 7/1982 Asick et al. ..... 439/609
4,457,575 7/1984 Davis et al. ..... 439/676
4,552,423 11/1985 Swengel, Jr. ..... 439/607
4,569,566 2/1986 Triner ..... 439/608
4,653,837 3/1987 Phillipson et al. ..... 439/607
4,678,121 7/1987 Douty et al. ..... 439/610

FOREIGN PATENT DOCUMENTS 59-198675 11/1984 Japan .

*Primary Examiner*—Eugene F. Desmond
*Attorney, Agent, or Firm*—Takeuchi Patent Office

[57] ABSTRACT

A modular connector consists of a plug and a jack. The plug has a first insulating housing containing terminals and a first metal case for covering the first insulating housing and having a closing piece for closing openings between the first metal case and the cable. The jack has an second insulating housing for containing contacts, a second metal case for covering the second insulating housing, and a connection piece mounted in the second insulating housing for making an electrical connection between the first and second metal cases.

7 Claims, 6 Drawing Sheets

MODULAR CONNECTOR WITH EMI COUNTERMEASURE

BACKGROUND OF THE INVENTION

1. Field of the Invention

The present invention relates generally to modular connectors, particularly to a modular connector with electromagnetic interference protection.

2. Description of the Prior Art

Recently, there is an increasing demand for electrical connectors with electromagnetic interference (EMI) protection. Japanese Pat. Kokai No. 59-198,675 ("'675 patent") and U.S. Pat. Nos. 4,569,566 ("'566 patent") and 4,457,575 ("'575 patent") disclose electrical connectors of this type. The '575 patent discloses a modular connector jack having a metal case for covering an insulating housing to prevent leakage of electromagnatic waves. The metal case of this modular connector jack has an integral contact tongue for contact with the metal case of a mating modular connector plug. The entire metal case is made of brass. The electrical connector plug of the '675 patent has a pair of metal case sections and a metal tube to provide an electromagnetic wave shield. The electrical connector plug of the '566 patent has a metal case mounted on the rear end of an insulating housing of contacts to provide an electromagnetic wave shield and an insulating case mounted on the rear end of the metal case.

Since the entire metal case of a modular connector jack of the '575 patent is made of brass, it is very difficult to give the contact tongue a spring property. As a result, the contact tongue can be broken after repeated plug in and off operations. If the entire metal case is made of a conductive material with a spring property in attempt to solve such a problem, it results in poor workability and the increased unit manufacturing cost. The electromagnetic wave shield of an electrical connector plug of the '675 patent consists of three components; two metal case sections and one metal base, requiring many steps of processing a harness and increasing the component cost and thus the unit manufacturing cost. The integral metal case of an electrical connector plug of the '566 patent is formed by drawing, making the processing cost high. In addition, there is a tendency to provide too much play between the insulating case and the rear portion of the metal case.

SUMMARY OF THE INVENTION

Accordingly, it is an object of the invention to provide a modular connector consisting of a plug and a jack, which is helpful for solving such problems.

According to the invention there is provided a modular connector comprising a plug which includes a first generally rectangular cross-section insulating housing having on the fornt portion a plurality of terminals to which conductors of a cable are connected; a first metal case having a rectangular cross-section cylindrical portion mounted on the rear portion of said insulating housing, a clamp portion extending from the rear end of said cylindrical portion and clamping the shield wires of said cable, and at least one closing piece provided on the rear end of said cylindrical portion to close openings between said cylindrical portion and said cable terminated to said terminals; and an insulating case mounted on the rear portion of said first metal case and a jack which includes a second insulating housing having a lower front cavity for receiving said modular connector plug and a plurality of contacts projecting into said lower front cavity so that they may come into contact with said terminals; a second metal case mounted on the front surface of said second insulating housing except for said lower front cavity; and at least one connection piece with an outwardly projecting contact tongue and an inwardly projecting contact tongue, said connection piece attached to a side wall of said lower front cavity so that said outwardly and inwardly projecting contact tongues may come into contact with said second and first metal cases, respectively.

Other objects, features, and advantages of the invention will be apparent from the following description taken in conjunction with the accompanying drawings.

DESCRIPTION OF THE PREFERRED EMBODIMENTS

Figure 1:
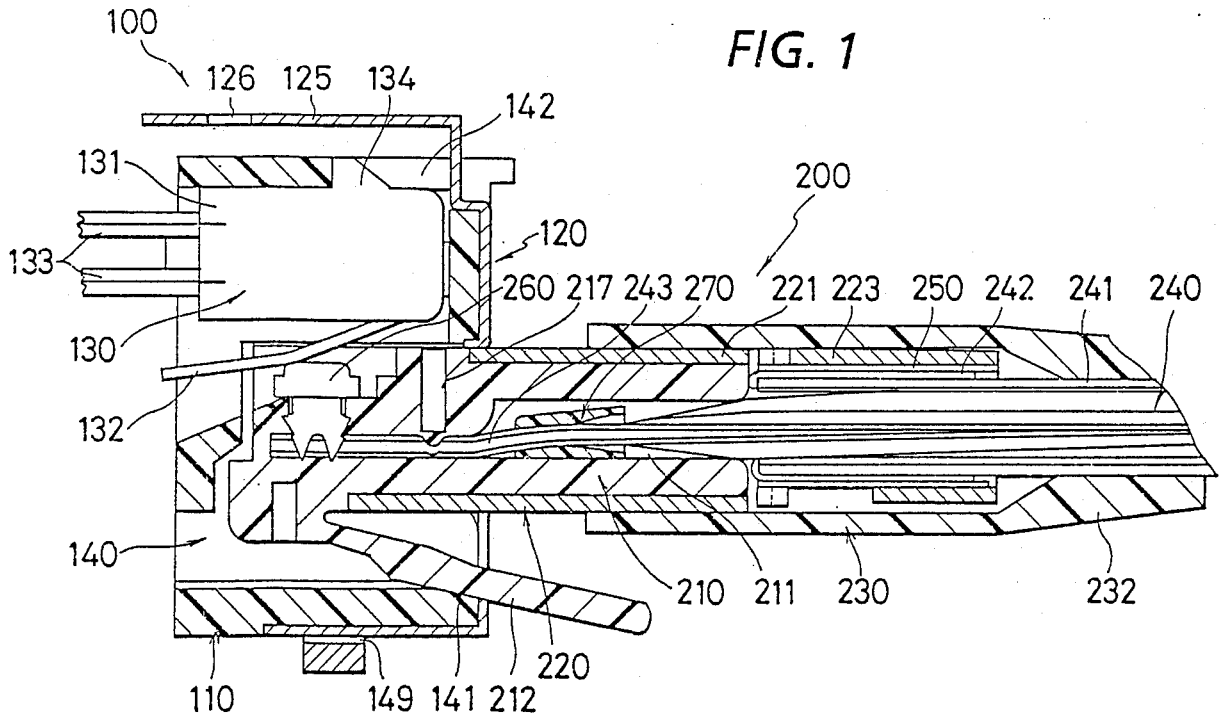
FIG. 1 is a sectional view of a modular connector plug connected to a modular connector jack according to the present invention.

Referring now to FIG. 1 there is shown a modular connector consisting of a plug 200 connected to a modular connector jack 100. The modular connector jack 100 has an insulating housing 110 which is integrally molded from a plastic or other insulating material. The insulating housing 110 has a lower front cavity 140 on its lower front surface for receiving the modular connector plug 200 and an upper rear cavity on its upper rear surface for receiving a contact assembly 130 consisting of an insulating block 131 and a plurality of contacts 132 mounted thereon. Conductors 133 connected to respective contacts 132 extend from the rear end of the insulating block 131.

A latch ear 134 provided on the upper surface of the insulating block 131 engages an edge of a latch opening 142 provided on the upper surface of the insulating housing 110 to prevent the insulating block 131 from coming off from the rear end. The respective contacts 132 are arranged on the upper surface of the lower front cavity 140 so that they may come to contact with respective terminals 260 of the modular connector plug 200 when connected. The details of the modular connector jack 100 will be described later with reference to FIGS. 2 through 4.

The modular connector plug 200 consists of an insulating housing 210 molded from a plastic or other insulating material to have a substantially rectangular corss-section, on the upper front end of which respective terminals 260 connected to respective conductors 243 of a cable 240 are mounted, a metal case 220 mounted over the insulating housing 210, and an insulating case 230 made of a plastic or other insulating material and mounted on the rear end of the metal case 220. The metal case 220 has a cylindrical portion 221 surrounding the insulating housing 210 and a clamp portion 223 extending from the rear end of the cylindrical portion 221 for clamping the shielded conductors 242.

Like the ordinary modular connector plug, the insulating housing 210 has a latch arm 212 extending rearwardly from the lower front end. This latch arm 212 engages a shoulder 141 provided on the bottom of the lower front cavity 140 of the insulating housing 110 to lock the connection between the modular connector jack 100 and the modular connector plug 200. The details of the modular connector plug 200 will be described later with reference to FIG. 3 and FIGS. 8 through 11.

Figure 2:
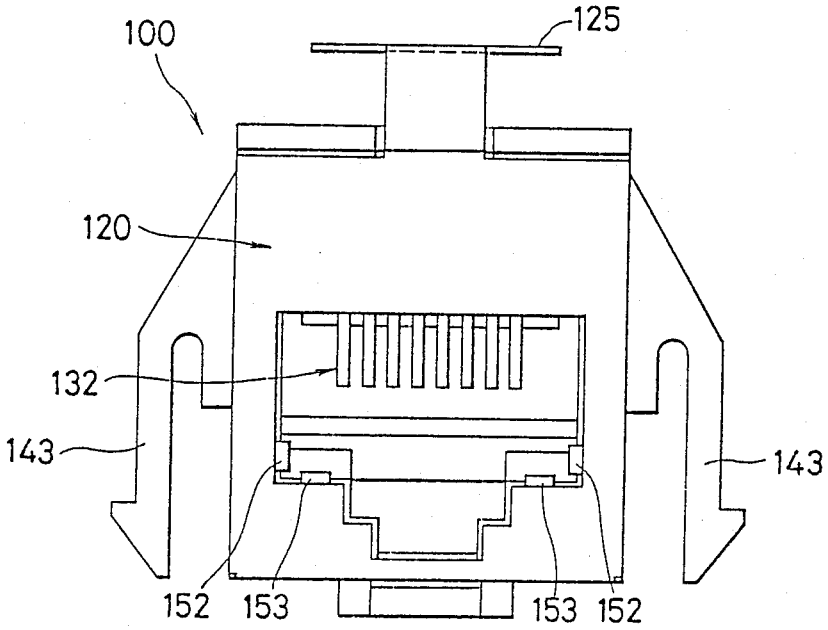
FIG. 2 is a front view of the modular connector jack of FIG. 1.
Figure 4:
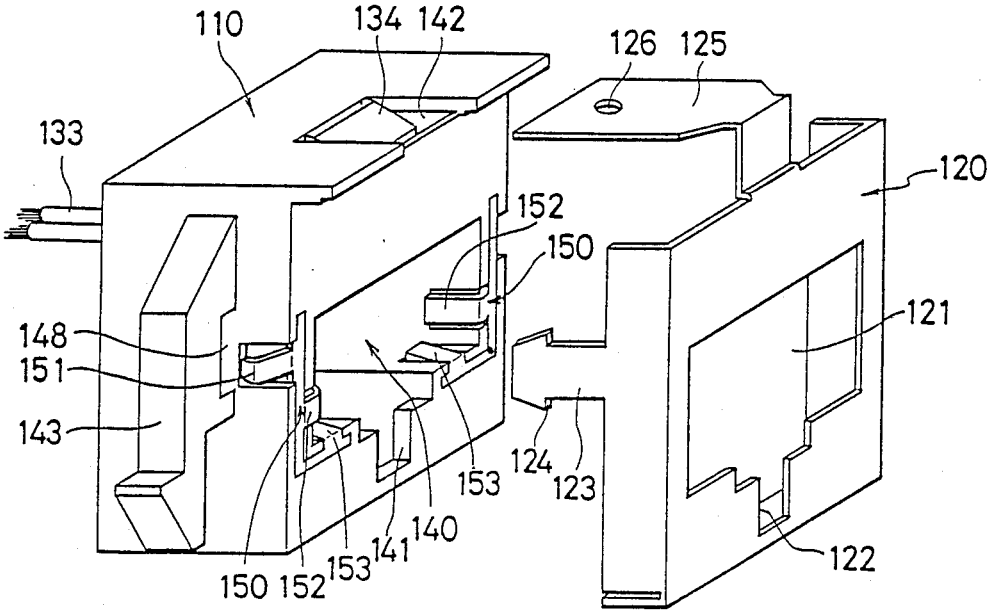
FIG. 4 is an exploded perspective view of the modular connector jack of FIG. 2.

FIGS. 2 and 4 show a front view of the modular connector jack 100 and an exploded view of the outer metal case 120 from the insulating housing 110. As best shown in FIG. 4, the modular connector jack 100 consists of the insulating housing 110, a pair of connection pieces 150, and the outer metal case 120 to be mounted on the front surface of the insulating housing 110. The insulating housing 110 has a pair of generally L-shaped recesses 144 on opposite sides of the lower front cavity 140 for receiving the connection pieces 150 and a pair of latch arms 143 on opposite sides of the insulating housing 110 for latching the modular connector jack to the mount panel.

Figure 5:
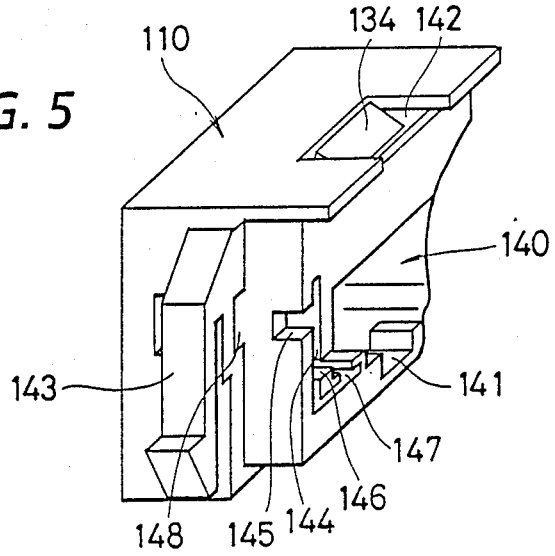
FIG. 5 is a perspective view of a part of the modular connector jack of FIG. 4.
Figure 6:
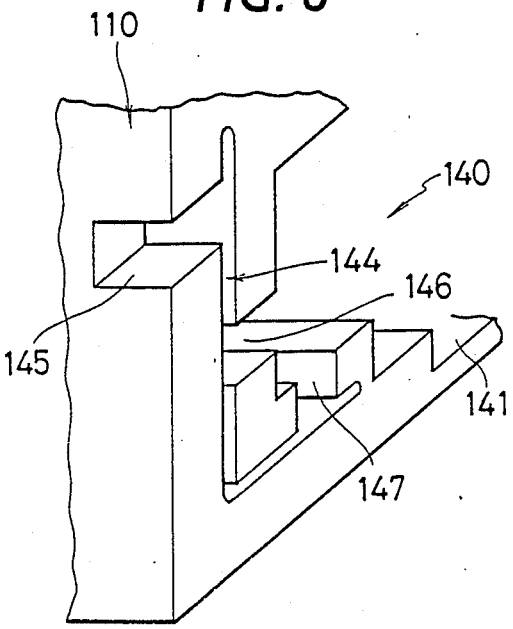
FIG. 6 is an enlarged view of an L-shaped recess of the modular connector jack of FIG. 5.

FIG. 5 shows a part of the insulating housing 110 from which the connection piece 150 has been removed. FIG. 6 is an enlarged view of the L-shaped recess 144 for receiving the connection piece 150. The recess 144 communicates with respective small recesses 145, 146, and 147 for receiving respective contact tongues 151, 152, and 153 of the connection piece 150. The end wall of the L-shaped recess 144 has a pair of slots (not shown) for receiving a pair of mounting legs 154 of the connection piece 150. The insulating housing 110 has a pair of latch slots 148 on opposite sides (FIG. 4) and a slot 149 (FIG. 1) on its bottom for receiving the latch legs 123 of the outer metal case 120.

The outer metal case 120 is made of brass or other electrically conductive material which is not necessarily very springy and plated with solder. As best shown in FIG. 4, the outer metal case 120 has a generally rectangular opening 121 through which the cylindrical portion 221 of the metal case 220 is inserted. A bottom recess 122 is provided on the lower edge of the rectangular opening 121 for receiving the latch arm 212 of the insulating housing 210. The outer metal case 120 has on opposite sides a pair of latch legs 123 which fit into the latch slots 148 of the insulating housing 110 to secure the metal case 120 to the front of the insulating housing 110. Although not shown, a similar latch leg provided on the bottom fits into the slot 149 of the insulating housing 110. Each latch leg 123 has a pair of barbs 124 on the leading part for engagement with the edge of the slot 148. The outer metal case 120 has a grounding piece 125 extending rearwardly from the central upper edge and having a grounding aperture 126 therein.

Figure 7:
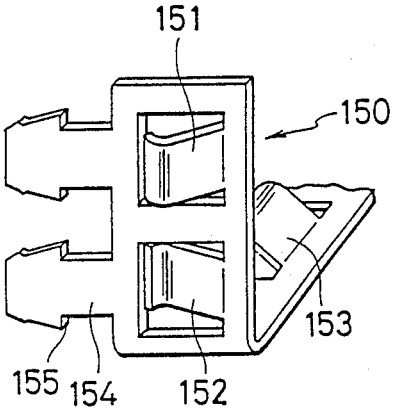
FIG. 7 is a perspective view of a connection piece to be fitted into the L-shaped recess of FIG. 6.

As best shown in FIG. 7, each connection piece 150 is made of phosphorus bronze, beryllium copper, or other springy, conductive material, and preferably plated with solder. It is formed in a generally L-shaped form. The vertical leg has an outwardly projecting tongue 151 and an inwardly projecting tongue 152, and the horizontal leg has an inwardly projecting tongue 153. The vertical leg also has a pair of latch legs 154 each having a pair of retention barbs 155.

To assemble such a connector jack 100, first of all, the insulating block 131 with respective contacts 132 connected to respective conductors 133 is inserted into the upper rear cavity of the insulating housing 110 until the latch ear 134 engages the edge of the latch opening 142. The individual connection pieces 150 are then fitted in the L-shaped recesses 144 provided on opposite sides of the insulating housing 110 in such a manner that the contact tongue 151 may project outwardly through the recess 145 into the latch slot 148 of the insulating housing 110 (FIG. 4). The contact tongues 152 and 153 project inwardly through the recesses 146 and 147 into the lower front cavity 140 of the insulating housing 110. Finally, the latch legs 123 of the outer metal case 120 are inserted into the latch slots 148 and 149 of the insulating housing 110 to secure the outer metal case 120 to the front of the insulating housing 110 so that the contact tongues 151 may come into contact with the latch legs 123 to make an electrical connection between the outer metal case 120 and the respective connection pieces 150.

As best shown in FIG. 2, the contact tongues 152 and 153 of each connection piece project into the lower front cavity 140 for contact with the sides and bottom of cylindrical portion 221 of the metal case 220 when the modular plug 200 is connected. As a result, the metal case 220 and the outer metal case 120 are electrically connected to each other through the connection pieces 150. Thus, the outer metal case 120 and the connection pieces 150 are able to prevent leakage of electromagnetic waves from the lower front cavity 140, thus providing an effective EMI countermeasure.

Figure 3:
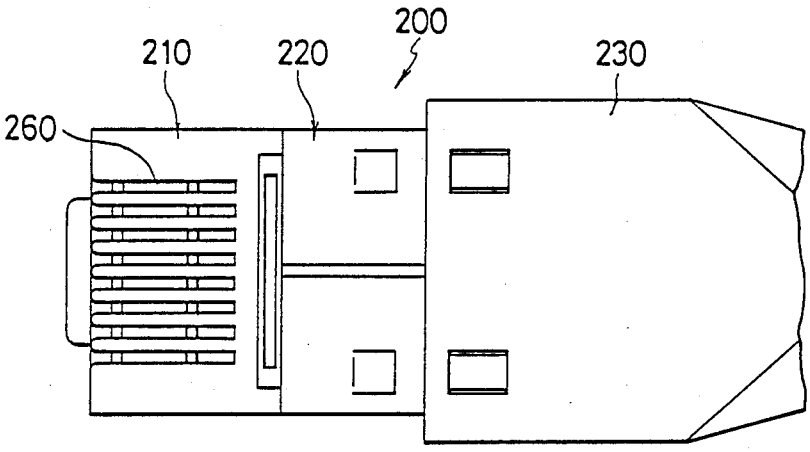
FIG. 3 is a plan view of the modular connector plug of FIG. 1.

FIG. 3 shows a top view of the modular connector plug 200 which consists of an insulating housing 210, a metal case 220, and an insulating case 230. The insulating housing 210 and the metal case 220 are shown in more detail in FIG. 8. The insulating housing 210 has an axial channel 211 for receiving the free ends of a cable 240 to be terminated. It has on the top a plulality of partition walls 213 for defining a pluarlity of terminal slots 214, and a transverse slot 217 for receiving a clamping tool. The insulating housing 210 also has a pair of latch openings 216 in the middle of the top and a pair of recesses 215 on opposite sides near the front end.

The metal case 220 is made of a sheet of brass or other conductive material, preferably plated with solder, and bent so as to have a generally rectangular cross-section cylindrical portion 221 and fit over the rear portion of the insulating housing 210, a clamp portion 223 extending from the rear end of the cylindrical portion 221 for clamping the shielded conductors 242 of a cable 240, and a pair of closing pieces 224 capable of being bent to close the gaps between the cylindrical portion 221 and the cable 240 inserted therein. A pair of support arms 225 extend from opposite rear ends of the cylindrical portion 221 so as to contact the inside of the insulating case 230 for preventing a loose connection between the metal case 220 and the insulating case 230. It is preferred to provide a pair of support legs 222 extending from opposite front ends of the cylindrical portion 221 so as to fit into the channels 215 provided on opposite sides of the insulating housing 210 for securing stable engagement between the insulating housing 210 and the metal case 220. Preferably, a pair of inwardly projecting ears 226 and a pair of outwardly projecting ears 227 are cut on the top of the cylindrical portion 221. Their function will be described later.

Figure 11:
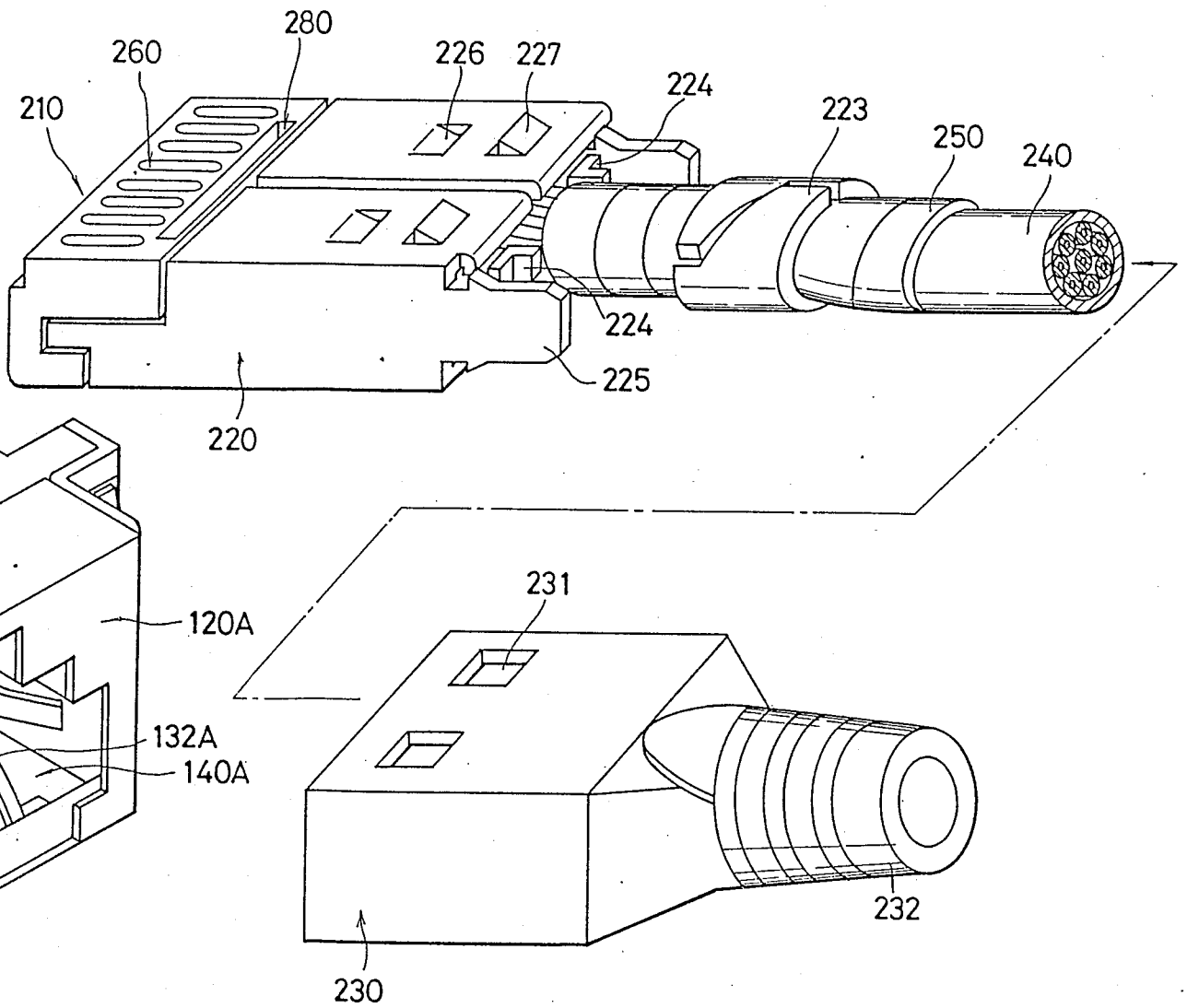
FIG. 11 is a perspective view of the cable terminated to terminals of the insulating housing of FIG. 9.

As best shown in FIG. 11, the insulating case 230 is made of a plastic or other insulating material so as to have a pair of latch openings 231 on the top and bottom near the front end and a sleeve portion 232 extending from the rear end.

Figure 9:
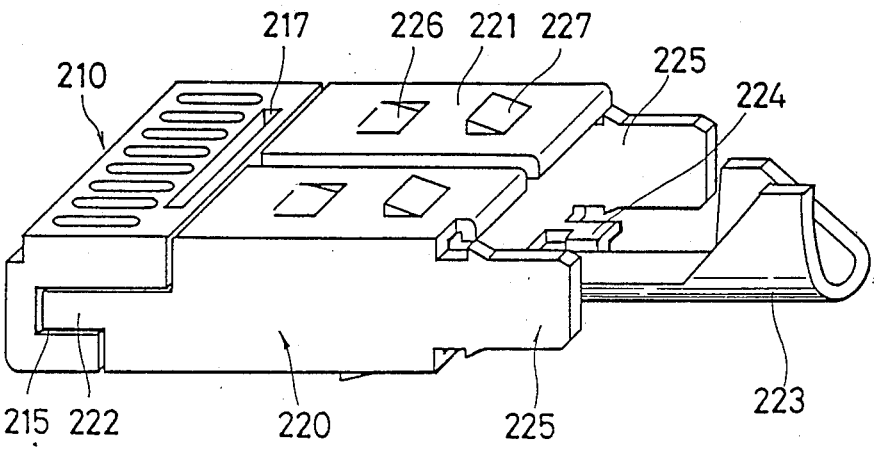
FIG. 9 is a perspective view of the insulating housing received in the metal case of FIG. 8.

A method of terminating a cable to such a modular connector plug will be described. First of all, as shown in FIG. 9, the cylindrical portion of the metal case 220 is mounted on the rear portion of the insulating housing 210 so that the support legs 222 may fit into the channels 215 of the insulating housing 210 and the inwardly projecting ears 226 may engage the edge of the latch openings 216 of the insulating housing 210 to latch the insulating housing 210 to the metal case 220.

Figure 10:
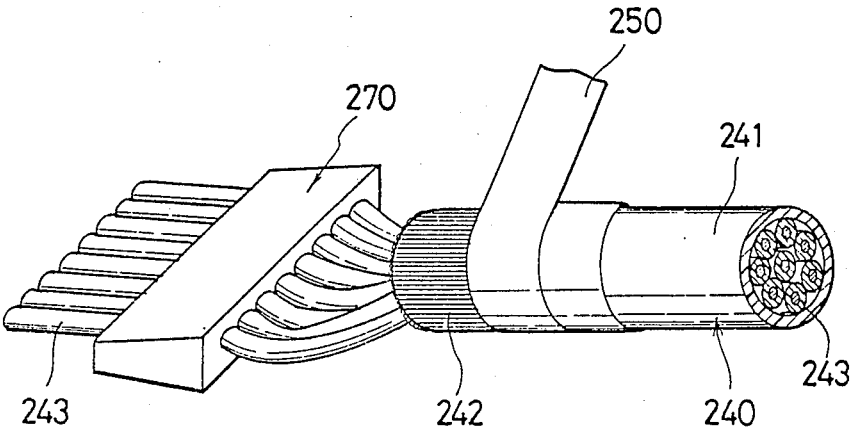
FIG. 10 is a perspective view of the prepared end of a cable to be terminated to the modular connector plug of FIG. 3.
Figure 8:
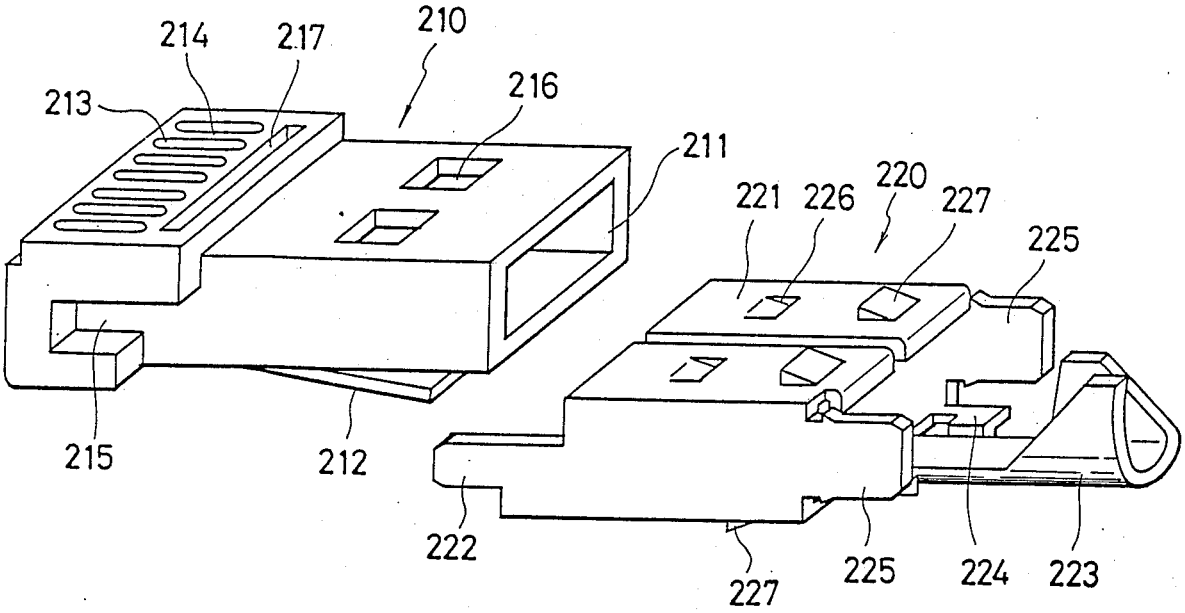
FIG. 8 is a perspective view of an insulating housing and a metal case of the modular connector plug of FIG. 3.

Then, as shown in FIG. 10, a length of the jacket 241 of a cable 240 is cut off and the exposed shield wires 242 are folded back on the jacket 241 and lapped with a conductive tape 250. Then, the separated conductors 243 are aligned with an aligning adaptor 243.

As shown in FIG. 11, the thus prepared cable 240 is inserted into the axial channel 211 of the insulating housing 210 through the cylindrical portion 221 of the metal case 220. Respecive terminals 260 are then press fitted into the respective slots 214 to pierce the insulator and make an electrical connection to respective conductors 243. A clamping tool is then inserted into the transverse slot 217 to press the bottom of the slot 217 for clamping the respective conductors. The clamp portion 223 of the metal case 220 is then crimped to the conductive tape 250 of the cable 240. The closing pieces 224 are bent upwardly to close the remaining openings between the cylindrical portion 221 and the cable 240.

Finally, the insulating case 230 is mounted over the rear portion of the metal case 220 to complete the modular connector plug 200 so that the outwardly projecting ears 227 may engage the latch openings 231 of the insulating housing 230 to latch the metal case 220 to the insulating case 230. The thus terminated modular connector plug 200 fitted into the lower front cavity 140 of the connector jack 100 is shown in FIG. 1 in section. The shielding wires 242 of the terminated cable 240 are electrically connected to the outer metal case 120 through the clamp portion 223 and cylindrical portion 221 of the metal case 220, the contact tongues 152 and 153 of the connection pieces 150, and the contact tongues 151 and the mounting legs 123, and further to the ground of the equipment through the grounding piece 125. Thus, the metal case 220 and the outer metal case 120 cooperate to prevent leakage of electromagnetic waves into or out of the modular connector plug and jack assembly, thus providing a satisfactory EMI countermeasure.

Figure 12:
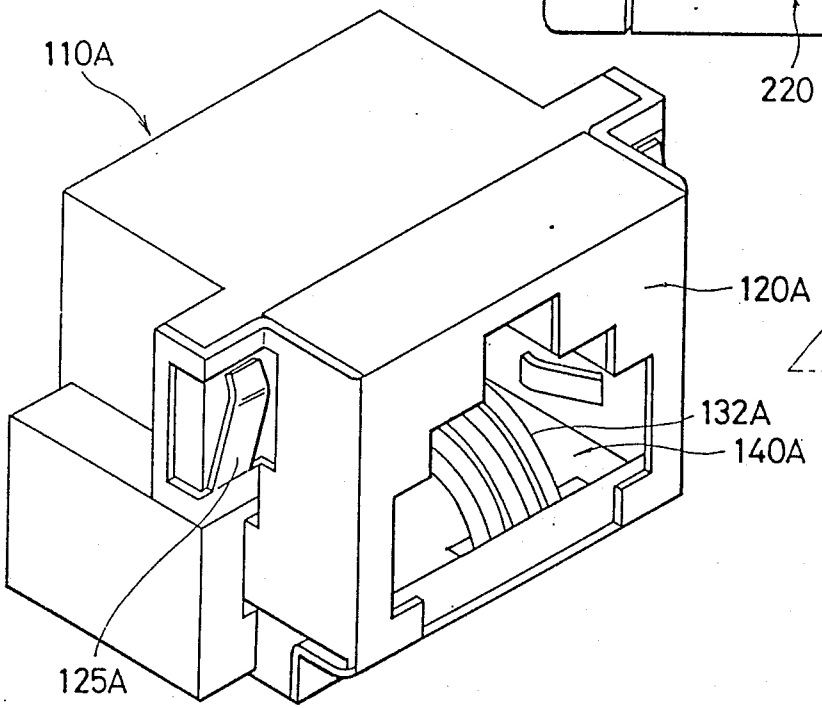
FIG. 12 is a perspective view of another modular connector jack according to the invention.
Figure 13:
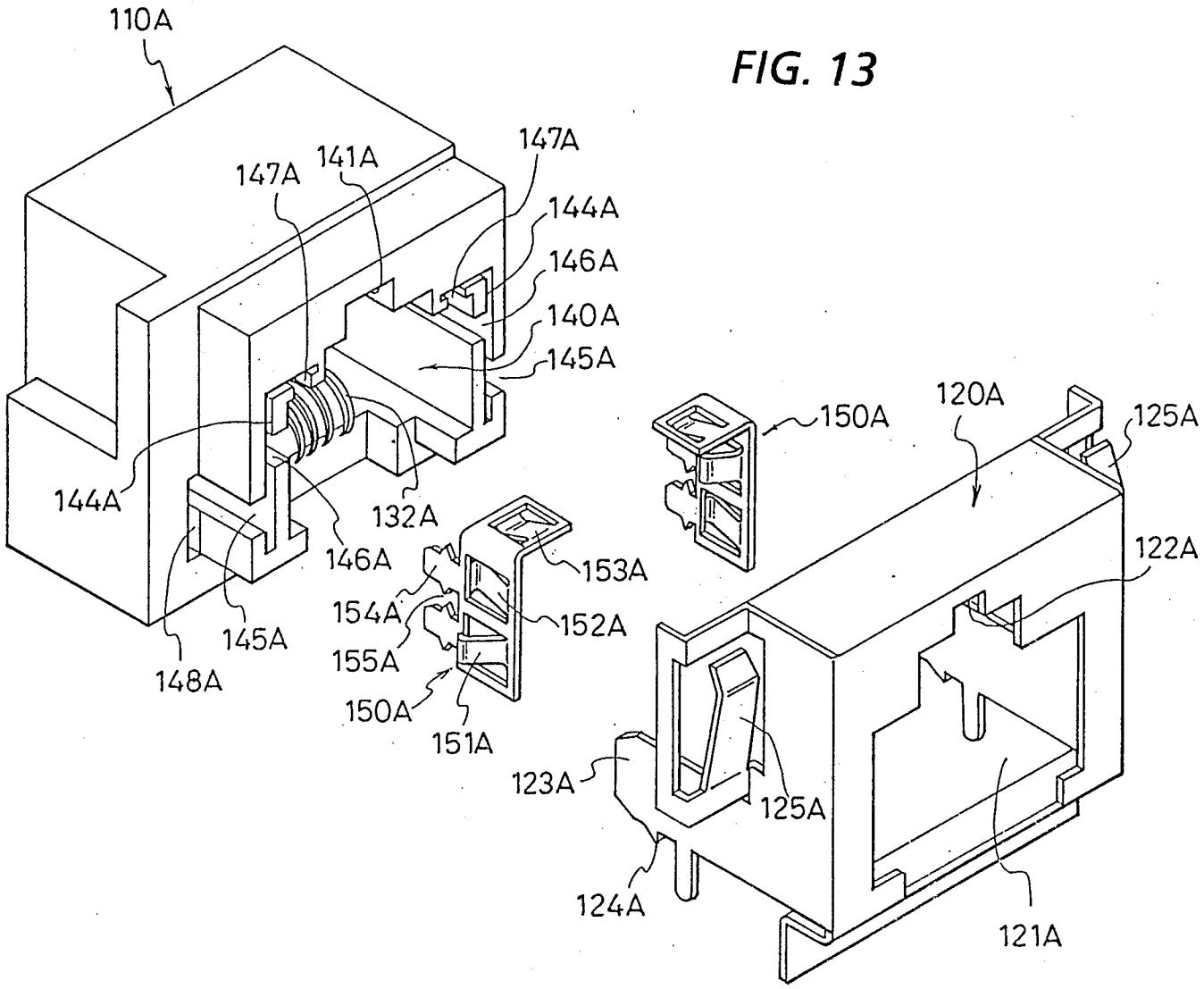
FIG. 13 is an exploded perspective view of the modular connector jack of FIG. 12.

FIGS. 12 and 13 show a perspective view of another modular connector jack embodying the present invention and an exploded view of the modular connector jack. This modular connector jack is designed to receive a grounding conductor provided on the backside of a mounting panel. Consequently, the outer metal case 120A has on opposite front sides a pair of contact tongues 125A for contact with the grounding conductors on the backside of the mounting panel. These contact tongues 125A are not required to be very springy because the mounting on or off of this modular connector jack is not frequent. Thus, the outer metal case 120A may be made of a material not very springy, such as brass, as in the case of the aforementioned outer metal case 120. This connector jack consists of an insulating housing 110A, an outer metal case 120A, and a pair of grounding pieces 150A. The other parts are substantially the same as those of the above modular jack 100 and are given a letter "A" affixed to the corresponding reference numerals, with the detailed description omitted.

As has been described above, according to the invention, the outer metal case is made of a conductive material without a spring property while the connection piece is made of a conductive material with a spring property so that not only the outer metal case is made less expensive but also the contact tongue is made springy and strong. Consequently, the entire metal case for an EMI countermeasure is made not only inexpensive but also resistant to breakage due to frequent plug in and off operations. The metal case may be formed by merely bending a stamped piece of metal into a rectrangular cross-section cylindrical form, thus reducing the unit manufacturing cost. Notwithstanding such a simple structure, the closing pieces of the metal case are very effective for preventing leakage of electromagnetic waves.

While a preferred embodiment of the invention has been described using specific terms, such description is illustrative purposes only, and it is to be understood that changes and modifications may be made without departing from the spirit and scope of the invention as recited in the following claims.

What is claimed is:

1. A modular connector comprising:

a plug which includes:

a first generally rectangular cross-section insulating housing having on the front portion a plurality of terminals to which conductors of a cable are connected;

a first metal case having a rectangular cross-section cylindrical portion mounted on the rear portion of said insulating housing, a clamp portion extending from the rear end of said cylindrical portion and clamping the shield wires of said cable, and at least one closing piece provided on the rear end of said cylindrical portion to close openings between said cylindrical portion and said cable terminated to said terminals; and an insulating case mounting on the rear portion of said metal case; and a jack which includes:

a second insulating housing having a lower front cavity for receiving said modular connector plug and a plurality of contacts projecting into said lower front cavity so that they may come into contact with said terminals;

a second metal case mounted on the front surface of said second insulating housing except for said lower front cavity; and at least one connection piece with an outwardly projecting contact tongue and an inwardly projecting contact tongue, said connection piece attached to a side wall of said lower front cavity so that said outwardly and inwardly projecting contact tongues may come into contact with said second and first metal cases, respectively.

2. A modular connector according to claim 1, wherein said second metal case is made of a conductive material with little spring property and said connection piece is made of a conductive material with spring property.

3. A modular connector according to claim 1, wherein said second metal case has a grounding piece.

4. A modular connector according to claim 1, wherein said second metal case has at least one contact tongue for contact with the grounding conductor provided on the backside of a mounting panel.

5. A modular connector according to claim 1, wherein said first metal case has a pair of supporting arms extending from the rear end of said cylindrical portion so as to contact with the inside of said insulating case.

6. A modular connector according to claim 1, wherein said first metal case has at least one inwardly projecting ear for engagement with said first insulating housing.

7. A modular connector according to claim 1, wherein said first metal case has at least one outwardly projecting ear for engagement with said first insulating case.

* * * * *